US006065424A

United States Patent [19]

Shacham-Diamand et al.

[11] Patent Number: 6,065,424

[45] Date of Patent: May 23, 2000

[54] ELECTROLESS DEPOSITION OF METAL FILMS WITH SPRAY PROCESSOR

[75] Inventors: Yosi Shacham-Diamand, Ithica, N.Y.; Vinh Nguyen, Eden Prairie, Minn.; Valery Dubin, Cupertino, Calif.

[73] Assignees: Cornell Research Foundation, Inc., Ithaca, N.Y.; FSI International, Inc., Chaska, Minn.

[21] Appl. No.: 08/768,447

[22] Filed: Dec. 18, 1996

Related U.S. Application Data

[60] Provisional application No. 60/008,848, Dec. 19, 1995.

[51] Int. Cl.[7] ..... B05C 5/00

[52] U.S. Cl. ..... 118/696; 118/52; 118/315; 118/319; 118/320

[58] Field of Search ..... 427/426, 425, 427/421, 443.1; 205/126, 187; 118/696, 52, 319, 320, 315; 366/159.1, 160.1, 162.1, 152.1; 239/407, 413, 444; 222/145.1, 145.5; 137/896, 606, 607, 115.01, 101.19

[56] References Cited

U.S. PATENT DOCUMENTS

| | | | |
|---|---|---|---|
| 2,938,805 | 5/1960 | Agens | 106/1 |
| 2,956,900 | 10/1960 | Carlson et al. | 117/47 |
| 3,075,855 | 1/1963 | Agens | 117/47 |
| 3,075,856 | 1/1963 | Lukes | 117/47 |
| 3,990,462 | 11/1976 | Elftmann et al. | 134/102 |
| 4,286,541 | 9/1981 | Blackwood | 118/52 |
| 4,525,390 | 6/1985 | Alpaugh et al. | 427/305 |
| 4,609,575 | 9/1986 | Burkman | 427/426 |
| 4,682,615 | 7/1987 | Burkman et al. | 134/102 |
| 4,894,260 | 1/1990 | Kumasaka et al. | 427/241 |
| 4,908,242 | 3/1990 | Hughes et al. | 427/443.1 |
| 5,077,090 | 12/1991 | Sawyer | 427/425 |
| 5,401,539 | 3/1995 | Coombs et al. | 427/422 |

FOREIGN PATENT DOCUMENTS

| | | |
|---|---|---|
| 7-34257 | 2/1995 | Japan . |
| 428 372 | 7/1967 | Switzerland . |
| 880414 | 10/1961 | United Kingdom . |

OTHER PUBLICATIONS

J. Li, et al, "Copper–Based Metallization in ULSI Structures", *MRS Bulletin 19* (Aug. 1994); p. 15.

J. Cho, et al. , Electroless Cu for VLSI, *MRS Bulletin* 18, (Jun. 1993); p. 31.

P.L. Pai et al, *IEEE Electron, Device Lett.*10 (1989); p. 423.

Edited by John L. Vossen et al, Academic Press, 1978, p. 210.

Casturi L. Chopra et al *Thin Film Phenomena*, 2d, 1979.

(List continued on next page.)

*Primary Examiner*—Laura Edwards

*Attorney, Agent, or Firm*—Vidas, Arrett & Steinkraus

[57] ABSTRACT

Electroless plating of very thin metal films, such as copper, is accomplished with a spray processor. Atomized droplets or a continuous stream of an electroless plating solution are sprayed on a substrate. The electroless plating solution may be prepared by mixing a reducing solution and a metal stock solution immediately prior to the spraying. The deposition process may be carried out in an apparatus which includes metal stock solution and reducing reservoirs, a mixing chamber for forming the plating solution, optionally an inert gas or air (oxygen) source, a process chamber in which the solution is sprayed on the substrate and a control system for providing solutions to the mixing chamber and the process chamber in accordance with a predetermined program for automated mixing and spraying of the plating solution. The process can be used to form metal films as thin as 100 Å and these films have low resistivity values approaching bulk values, low surface roughness, excellent electrical and thickness uniformity and mirror-like surface. Low temperature annealing may be used to further improve electrical characteristics of the deposited films. The thin metal films produced by the disclosed process can be used in semiconductor wafer fabrication and assembly, and in preparation of thin film discs, thin film heads, optical storage devices, sensor devices, microelectromachined sensors (MEMS) and actuators, and optical filters.

9 Claims, 3 Drawing Sheets

OTHER PUBLICATIONS

Goldie et al, "Electroless Copper Deposition," *Plating*, 51, (1965), p. 1069–1074.
F. A. Lowenheim, "Deposition of Inorganic Films from Solution", Edited by John L. Vossen et al, Academic Press, *Thin Film Processes*, pp. 209–256.
R.M. Lukes, "The Chemistry of the Autocatalytic Reduction of Copper by Alkaline Fomraldehyde", *Plating*, 51, 1066–1068 (1964).
T. M. Mayer et al., "Selected Area Processing" in *Thin Film Processes*, Edited by John L. Vossen et al, Academic Press, (1991), p. 621.
H. Honma et al., "Electroless Copper Deposition Process Using Glyoxylic Acid as a Reducing Agent", *J. Electrochem. Soc.* (Mar. 1994), p. 730–733.
K. Graff, "Metal Impurities in Silicon–Device Fabrication", (1995), pp. 81–89.
J. M. Martinez–Duart et al., "Micrometallization Technologies", *Reduced Thermal Processing for ULSI*, R. A. Levy ed., (1988), p. 269–294.
D. G. Ong, "Modern MOS Technologies: Processes, Devices, and Design", (1984), p. 124–129, 172–177.
A. Brenner et al., "Temperature Coefficients for Proving Rings", *J. Res. Natl. Bur. Stan.* 37 (1946), p. 31–41.
I. Ohno, "Electrochemistry of Electroless Plating", *Materials Sci. And Engin*, A146, (1991), 33–49.
J. E. A. Van den Meerakker et al., "On the Mechanism of Electroless Plating. Part 3. Electroless Copper Alloys", *J. App. Electrochem.* 20, (1990), 85–90.
R. Schumacher et al., "Kinetic Analysis of Electroless Deposition of Copper", *J. Phys. Chem.* 89 (1985) pp. 4338–4342.
A. Hung et al., "Mechanism of Hypophosphite–Reduced Electroless Copper Plating", *J. Electrochem. Soc.* 136 (1989), p. 72–75.
L. N. Schoenberg, "The Structure of the Complexed Copper Species in Electroless Copper Plating Solutions", *J. Electrochem. Soc.*118 (1971), p. 1571–1576.
A. Molenaar et al., "Kinetics of Electroless Copper Plating With EDTA as the Complexing Agent for Cupric Ions", *Plating*, 61 (1974) p. 238–242.
J. Dumesic et al., "The Rate of Electroless Copper Deposition by Formaldehyde Reduction", *J. Electrochem. Soc.* 121, (1974), 1405–1412.
P. Singer, "New Interconnect Materials: Chasing the Promise of Faster Chips", *Semiconductor International* (Nov. 1994), p. 52–56.
Y. Okinaka et al., "Photocurrents Induced by Subbandgap Illumination in a Ti–Oxide Film Electrode", *J. Electrochem. Soc.*, 126 (1976) p. 475–478.
Y. Shacham–Diamand et al., "Electroless Copper Deposition for ULSI Metallization", *Thin Solid Films*, vol. 262, Jun. 15, 1995, 93–103.
A. Brenner et al., "Nickel Plating Steel by Chemical Reduction", *Proc. Am. Electroplat. Soc.* (1946), p. 23–29.
Mercury® MP Spray Processing System Data Sheet, FSI International (1995).
Mercury® MP Spray Processing Systems brochure, FSI International (Date unknown).
G. Krulik, Kirk–Othmer Concise Encyclopedia of Chemical Technology (1985), 407.
C.Y. Mak, "Electroless Copper Deposition on Metals and Metal Silicides", *MRS Bulletin* 19, (Aug. 1994); p. 55.
Y. Shacham–Diamand, "100 nm Wide Copper Lines Made by Selective Electroless Deposition", *J. Micromech. Microeng*.1 (1991), 66.
J. Li, et al, "Copper–Based Metallization in ULSI Applications", *MRS Bulletin* 18 (Jun. 1993); p. 18.
S.P. Muraka, et al., "Inlaid COpper Multilevel Inter connections Using Planaraization by Chemical–Mechanical Polishing", *MRS Bulletin* 18 (Jun. 1993); p. 46.
E. B. Saubestre, "Electroless Copper Plating", *Technical Proceedings of the Golden Jubilee Convention American Electroplaters' Society*, (1959), 264–276.
M.E. Thomas et al., "Issues associated with the use of electroless copper films for submicron multilevel interconnections", 1990 Proceedings, Seventh Annual IEEE VLSI Multilevel Interconnection Conference (Cat No. 90TH0325–1), Santa Clara, CA, USA, Jun. 12–13, 1990, New York, NY, USA, pp. 335–337.
Database WPI, Section Ch, Week 9515, Derwent Publications Ltd., London, GB; Class M13, AN 95111044 XP002031618 & JP 07 034 257 A (SONY), Feb. 3, 1995.

ELECTROLESS DEPOSITION OF METAL FILMS WITH SPRAY PROCESSOR

CROSS REFERENCE TO RELATED APPLICATION

This application claims priority now abandoned U.S. provisional application 60/008,848, filed Dec. 19, 1995, incorporated herein by reference.

FIELD OF THE INVENTION

The present invention pertains to an article having a very thin metal film thereon, the film having substantially the same electrical characteristics as the bulk metal, and to a method of preparing such films by an electroless plating technique.

BACKGROUND OF THE INVENTION

In ultralarge-scale integration (ULSI) structures, high circuit speed, high packing density and low power dissipation are needed and, consequently, feature sizes must be scaled downward. The interconnect related time delays become the major limitation in achieving high circuit speeds. Shrinking device size automatically miniaturizes the interconnect feature size which can increase interconnect resistance and interconnect current densities. Poor step coverage of metal in deep via holes also increases interconnect resistance and electromigration failures. As a result of all these factors, replacing current aluminum interconnect materials with lower resistance metal materials has become a critical goal for semiconductor device manufacturers. Using metal films with low resistivities will automatically decrease the RC ("Resistance Capacitance") time delay and this is a huge benefit.

For comparable performance characteristics, aluminum interconnect lines have a current density limit of $2\times10^5$ amp/cm$^2$ versus a current density limit of $5\times10^6$ amp/cm$^2$ level for copper lines. Copper electromigration in interconnect lines has a high activation energy, up to twice as large as that of aluminum. Consequently, copper lines that are much thinner than aluminum lines can be used, therefore reducing crosstalk and capacitance. Generally, using copper as an interconnect material leads to one-and-a-half times improvement in the maximum clock frequency on a CMOS (complementary metal-oxide semiconductor) chip over aluminum-based interconnects for devices with effective channel lengths of 0.25 $\mu$m. These electrical characteristics of copper provide a strong incentive for developing copper films as interconnect layers in ULSI devices as well as top metal layers. Performance advantages and processing problems for copper and several other metal substitutes for aluminum have been compared in terms of 5,000 Å thick thin films.

References providing background information on these problems and current ULSI research include articles by J. Li, T. Seidel, and J. Mayer, *MRS Bulletin* 19 (August 1994) p. 15; J. Cho, H. Kang, S. Wong, and Y. Shacham-Diamand, *MRS Bulletin* 18 (June 1993) p. 31; and P. L. Pai and C. H. Ting, *IEEE Electron Device Lett.* 10 (1989) p. 423.

Because copper-based interconnects may represent the future trend in ULSI processing, there has been extensive development work on different copper processing techniques. The present state of the art consists of the following copper deposition and via-filling techniques: plating (such as electroless and electrolytic), sputtering (physical vapor deposition, PVD), laser-induced reflow, and CVD (chemical vapor deposition). Copper PVD can provide high deposition rate, but the technique leads to poor via-filling and step coverage. The laser reflow technique is simply not compatible with current VLSI process steps in semiconductor fabrication. Because of all these factors, J. Li et al., in *MRS Bulletin* 19 (August 1994) p. 15, stated that copper CVD is "the most attractive approach for copper-based multilevel interconnects in ULSI chips". High copper CVD deposition rates (>250 nm/min) at low substrate temperatures are needed to meet throughput requirements in device manufacturing. However, a trade-off exists between deposition rate and desirable film characteristics, such as low resistivity, good step coverage, and complete via filling.

Consequently, other process techniques are under consideration, even though at first, they do not seem as close a fit as Cu CVD does. One such process technique includes electroless plating. Electroless plating is an autocatalytic plating technique, specifically deposition of a metallic coating by a controlled chemical reduction that is catalyzed by the metal or alloy being deposited. Electroless deposition depends on the action of a chemical reducing agent in solution to reduce metallic ions to the metal. However, unlike a homogeneous chemical reduction, this reaction takes place only on "catalytic" surfaces rather than throughout the solution. References providing background information about electroless plating include *Thin Film Processes*, edited by John L. Vossen and Werner Kern, Academic Press, 1978, p. 210; and *Thin Film Phenomena,* 2d. ed., Casturi L. Chopra, Robert E. Kreiger, 1979.

Electroless plating has been used to deposit Ni, Co, Fe, Pd, Pt, Ru, Rh, Cu, Au, Ag, Sn, Pb, and some alloys containing these metals plus P or B. Typical chemical reducing agents have included $NaH_2PO_2$ and formaldehyde. Simply by immersing a suitable substrate in the electroless solution, there is a continuous buildup of a metal or alloy coating on the substrate. A chemical reducing agent in the solution is a source of the electrons for the reduction $M^{n+}+ne$ $M^0$, but the reaction takes place only on "catalytic" surfaces. Because it is "autocatalytic", once there is an initial layer of deposited metal, the reaction continues indefinitely. Due to this factor, once deposition is initiated, the metal deposited must itself be catalytic in order for the plating to continue.

In a conventional electroless copper plating process, the substrate to be plated is immersed in a stirred bath of the copper electroless solution. This causes several disadvantages:

(1) A variety of additives, such as surfactants, stabilizers, or the like, which are conventionally employed in such baths can have negative effects on the purity, and thus the conductivity, of very thin film of deposited copper. Such additives are typically gradually consumed in the deposition process. They may be decomposed and the products in part incorporated into the deposit or released back into the electrolyte.

(2) The concentration of copper ion in the immediate vicinity of the deposition surface is less than that of the bulk solution because of plating out of the copper ions. The chemical imbalance at this interface can adversely affect the morphology of the plated copper. A rough surface, with high inclusion of contaminants, such as hydrogen gas, byproducts of surfactants and stabilizers, can result.

(3) Periodic refreshing of reactants at the substrate/solution interface is needed to furnish new ions and remove byproducts away from the substrate, in order for a smooth copper surface and higher plating rate to occur. Forced convection is typically used to bring fresh reactants closer to the interface. However, close to the substrate surface, frictional forces between the metal and solution operate to halt or retard the streaming fluid. Therefore, at the substrate surface where forced convection is negligible, diffusion is the only physical mechanism that can transport reactants to the interface.

A spray process for electroless deposition of copper onto sensitized and activated non-conductive substrates, such as Bakelite circuit board material, using a compressed air carrier, is reported in Goldie, "Electroless Copper Deposition," *Plating,* 51, (1965), 1069–1074.

SUMMARY OF THE INVENTION

Electroless copper plating of very thin films can be done with a spray processor. In place of a liquid immersion, the invention involves spraying atomized droplets of an electroless plating solution on a substrate. Alternatively the electroless plating solution can be dispensed via a spray which fans the solution, streams, or otherwise dispenses the solution in a conical pattern onto the wafer. The process can be used to form metal films as thin as 100 Å and these very thin films have low resistivity values approaching bulk values, low surface roughness, excellent electrical and thickness uniformity and mirror-like surface. The thin film has electrical characteristics comparable to much thicker films obtained by other processes. Deposited films of 200 Å have electrical resistivity values matching those of CVD, sputtered, or immersion electroless plated films that are twenty to one hundred times thicker. Films of 200–500 Å thickness have characteristics comparable to bulk values, especially after low temperature annealing.

In an embodiment the electroless plating solution is prepared by mixing a reducing solution and a metal stock solution immediately prior to the spraying operation. The high quality deposited films can be obtained with electroless plating solutions which contain little or no surfactant additive.

These thin films prepared by the method of the invention can be used in semiconductor wafer fabrication and assembly. Other application areas include thin film discs, thin film heads, optical storage devices, sensor devices, microelectromachined sensors (MEMS) and actuators, and optical filters. The process can be tailored to a multitude of substrates and film materials and it can be used to create layers of different chemical composites with yet-to-be discovered characteristics.

An apparatus specially configured for carrying out the process of the invention provides a further aspect of the invention.

DETAILED DESCRIPTION OF THE INVENTION

Figure 1:
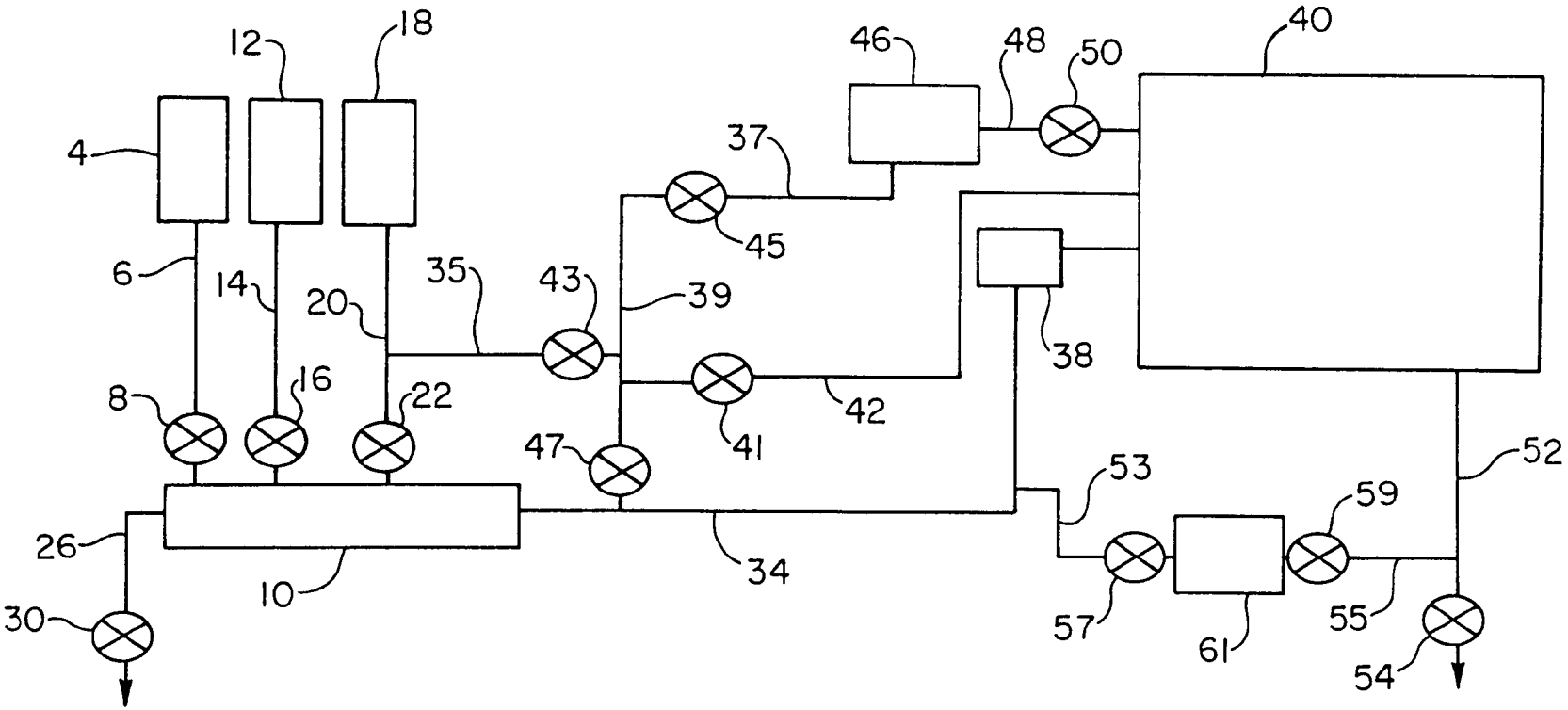
FIG. 1 is schematic representation of a preferred apparatus for use in carrying out the present invention.

A detailed description of the chemical reactions and process sequence involved in electroless plating can be found in *Thin Film Processes* on pg. 217 (edited by John L. Vossen and Werner Kern, Academic Press, 1978) and "The Chemistry of the Autocatalytic Reduction of Copper by Alkaline Formaldehyde" by R. M. Lucas (*Plating,* 51, 1066 (1964)).

Electroless plating solutions include a deposition metal source and a reducing agent. A dissolved metal salt functions as the deposition metal source. In one embodiment of the invention the electroless plating solution is formed shortly before use, suitably within 30 minutes before it is sprayed onto the substrate. This is most conveniently accomplished by automated in-line mixing of a metal stock solution containing the deposition metal salt and a reducing agent solution.

In the case of copper deposition, the metal stock solution contains a copper salt, usually cupric sulfate ($CuSO_4$), as a source of copper ions, and a complexing or chelating agent to prevent precipitation of copper hydroxide. Suitable formulations for the chelating agent include tartrate, ethylenediaminetetraacetic acid (EDTA), malic acid, succinic acid, citrate, triethanolamine, ethylenediamine, and glycolic acid. The most preferred formulation is EDTA.

Suitable reducing agents include hypophosphite, formaldehyde, hydrazine, borohydride, dimethylamine borane (DMAB), glyoxylic acid, redox-pairs (i.e., Fe(II)/Fe(III), Ti(III)/Ti(IIII), Cr(II)/Cr(III), V(II)/V(III)) and derivatives of these. In this invention, formaldehyde is the most preferred formulation for the reducing solution. Since the reducing power of formaldehyde increases with the alkalinity of the solution, the solutions are usually operated at pH above 11. The required alkalinity is typically provided by sodium hydroxide (NaOH) or potassium hydroxide (KOH). Other bases, including quaternary ammonium hydroxides such as TMAH (tetramethyl ammonium hydroxide) and choline hydroxide, may also be used. TMAH and similar organic bases have the advantage that the solution can be made without alkali ions which are contaminants for the VLSI manufacturing process.

For each mole of copper electrolessly plated, at least 2 moles of formaldehyde and 4 moles of hydroxide are consumed and 1 mole of hydrogen gas evolved.

catalytic surface $$Cu^{2+}+2HCHO+4OH \longrightarrow Cu^{o}+H_2+2H_2O+2HCOO-$$

In practice, more formaldehyde and hydroxide are consumed than indicated in the above equation. This is attributed to the disproportionation of formaldehyde with hydroxide into methanol and formate.

$$2HCHO+OH \longrightarrow CH_3OH+HCOO-$$

Surfactants such as polyethylene glycol are conventionally employed in electroless plating solutions and may be included in the sprayed solutions employed in the invention. However, surprisingly it has been found that the use of a surfactant is not necessary to obtain good film properties and therefore it is preferred that if employed a surfactant be used at a level substantially less, suitably ½ or less, than conventional for immersion systems. By using such low levels of surfactant the potential of contamination of the film layer from surfactant residue is reduced and there is a reduced likelihood of foaming of the deposition solution during spraying in combination with an inert gas.

To further assure that the potential for contamination of the deposited film is minimized and that the deposition can be controlled to reproducibly deposit a desired thickness of metal within a predictable time period it is preferred that the stock solutions, especially the reducing agent solution, be formulated within about 24 hours or less prior to the time they are mixed and sprayed. The starting chemicals from which the stock solutions are made should be of high purity; most preferably, the chemicals are electronic grade or semiconductor grade.

The plating solution is sprayed onto an activated substrate which will initiate the autocatalytic deposition of the plating solution metal. In a preferred embodiment the plating solution is heated to a temperature of 50 to 90° C. prior to spraying, suitably with an in-line heater such as an IR heater.

The activated substrate or seed layer may be any conducting material which will initiate the autocatalytic deposition of the deposition metal from the electroless plating solution. Preferably, it is one of the following materials: copper, gold, silver, platinum, iron, cobalt, nickel, palladium, or rhodium. The substrate may be a metal seed layer on an underlying semiconductor device made of a material such as silicon, gallium arsenide, or silicon oxide. The seed layer may be deposited on the device by a plating, evaporation, CVD or sputtering technique in accordance with conventional procedures. A suitable thickness for such a seed layer is in the range of from about 50 to about 1000 Å. The seed layer may be deposited as a single stratum or as a multi-strata layer including an underlying adhesion/barrier stratum and an overlying seed stratum. The seed layer may be continuous over large areas or patterned. Suitable adhesion/barrier materials include Ti/TiN, Ta/TaN, Ta/SiN, W/WN, Ti/W and Al.

The plating solution may be sprayed in a manner which forms very fine droplets and may be carried in an inert gas. The term "atomize" as used herein refers to spraying or discharging liquids by dispersing the liquid into droplets. Atomization occurs in all embodiments of the invention whether or not an inert carrier gas is used to spray the solution. Suitably the plating solution is ejected as a series of fine streams from a plurality of orifices having an opening size of about 0.017–0.022 inch (0.043–0.056 cm) at a pressure of up to 30 psi (207 kPa) preferably about 20 psi (138 kPa), the streams being broken up so as to atomize the spray by an angularly crossing stream of high velocity inert gas ejected from similarly sized orifices at a pressure of about 20 to 50 psi (138–345 kPa). A suitable spray rate for such a processor is in the range of 100 to 2000 ml/minute, more suitably 150 to 1500 ml/minute. A suitable fan nozzle has orifices of 1.25 mm to 2.00 mm with approximately 10–15 orifices. A suitable fan nozzle is available from Fluoroware of Chaska, Minn. as Part No. 215-15. Suitable inert gases include nitrogen, helium and argon. Purified air or oxygen can be also used to atomize the spray. For thin film copper deposition onto seed layer substrates carried on a semiconductor device nitrogen gas, preferably electronic grade and more preferably semiconductor grade, is suitable.

It is also possible to spray the plating solution using nozzles which form generally continuous blade or cone streams, rather than atomized droplets. In such case, an inert gas feed be provided to the process chamber apart from the spray field so that the deposition is accomplished in an inert gas environment.

The high velocity spray provides active replenishment of the plating solution at the substrate/solution interface. To further increase the kinetic energy of the system and thereby assist in turning over the depleted solution, as well as making sure that the spray uniformly coats the substrate, the substrate article is desirably rotated or spun about an axis during the spraying operation. For instance, in the case of a semiconductor wafer carrying a seed layer thereon, the wafer may be rotated about its own axis or the wafer may be mounted in a carrier which is rotated so that the wafer orbits about a rotation axis. The wafers may be oriented substantially horizontally or vertically. In either case the spray orifice is suitably located so as to cause the spray to transversely contact the wafer surface to be plated. This technique facilitates both the rapid turn over of solution at the substrate/solution interface and the rapid removal of spent solution from the wafer surface. The rotation axis may extend vertically, horizontally or at an angle in between horizontal and vertical.

In some cases the rapid turnover of plating solution will provide a waste stream which remains a highly active and substantially pure plating solution. It is possible to recirculate such solution, mixing it with fresh solution if necessary to maintain activity while optimizing solution usage.

After the metal film is deposited on the substrate, the film can be annealed, suitably at a temperature of from about 200° C. to about 450° C. for 0.5 to 5 hours in a vacuum or an inert or reducing atmosphere such as dry nitrogen, argon, hydrogen or mixtures of hydrogen and nitrogen or argon. Annealing under such conditions has been observed to stabilize, and in some cases improve, the electrical properties of the deposited film.

Figure 2:
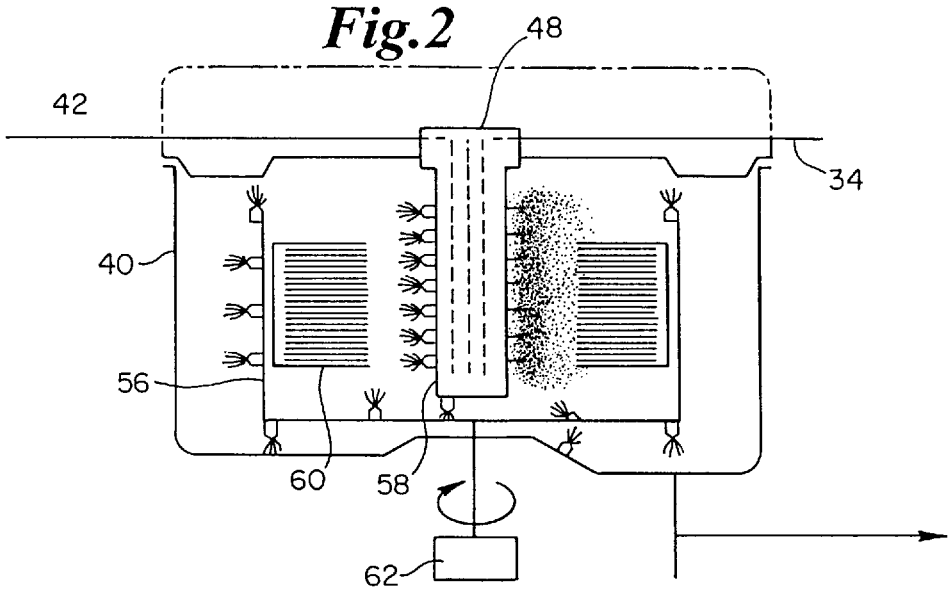
FIG. 2 is a side sectional view of a preferred deposition chamber for use in carrying out the present invention.
Figure 3:
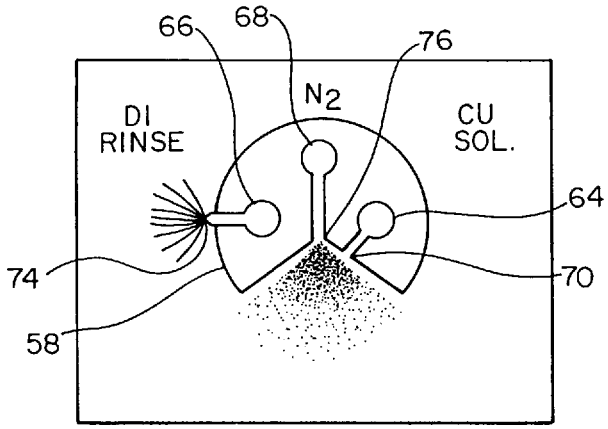
FIG. 3 is an enlarged cross-sectional view of a spray post for the deposition chamber of FIG. 2.

Referring to the drawings, there is shown in FIGS. 1–3 a preferred apparatus for use in practice of the invention. A first reservoir 4 contains a metal stock solution. The metal stock solution is connected via line 6 to a manifold 10. A metering valve 8 allows precise control of the flow of the metal stock solution to the manifold 10. A second reservoir 12 contains a reducing solution and is connected via line 14 and metering valve 16 to manifold 10. A high purity deionized (DI) water source 18 may be connected via line 20 and metering valve 22 to manifold 10. Waste can be removed from manifold 10 by opening valve 30 in line 26.

Manifold 10 serves as the mixing chamber in which the electroless plating LIT, solution is prepared by supplying to the manifold 10 metal stock solution and reducing agent solution, optionally diluting the mixture with DI water, at predetermined rates. From the manifold 10, the prepared electroless plating solution is carried via supply line 34 to a process chamber 40 into which the article to be plated is placed. An IR heater 38 is provided along supply line 34 to allow for heating of the plating solution if desired. Heater 38 is provided with appropriate sensors and controls to monitor and heat the solution in supply line 34 to a predetermined temperature.

A nitrogen source 46 is connected via line 48 and valve 50 to the process chamber 40. The nitrogen source is provided with a pressure regulator so that the pressure of the gas supplied to the chamber may be regulated as desired. Spent electroless deposition solution and water can be removed from the process chamber via waste line 52 and valve 54. Optional lines 53, 55, valves 57, 59 and pumped tank 61 provide a normally closed connection to supply line 34 so as to allow for recirculation of the spent solution if desired. In the event that recirculation of the solution is practiced, the apparatus does not include an IR heater. Rather, a heating and cooling coil is provided in the tank which holds the solution to allow for precise control of the temperature of the plating solution.

To flush the manifold 10, and supply line 34, a DI water line 35 and a nitrogen line 37 are connected to supply line 34 via line 39 and valves 43, 45 and 47. This arrangement allows rinsing of line 34 forward into the process chamber and backward through manifold 10. Rinse waste is removed from the process chamber 40 via line 52 and valve 30, and from the manifold via line 26 and valve 30. After rinsing supply line 34 and manifold 10, nitrogen is flowed to drive out rinse water and dry supply line 34 and manifold 10.

Valve 41 and line 42 provide an optional separate supply line for water and/or nitrogen to the process chamber 40. This allows for substantially immediate termination of the deposition reaction by immediately spraying rinse water on the substrate at the end of the deposition cycle without waiting for the supply line 34 to be flushed. Supply line 34 can be simultaneously flushed using only a low flow so that its contents are not sprayed at the substrate or only reach the substrate in very dilute form.

While fluid flow through the apparatus may be provided by mechanical pumps it is preferred that pressurized inert gas be used to force flow when a valve is opened. Pressurized connections, not shown, between nitrogen source 46 and the reservoirs 4, 12 and 18 may be provided for this purpose.

A suitable process chamber 40 is shown in FIG. 2. Process chamber 40 is sealed from the ambient environment and it contains a turntable 56 and a central spray post 58 containing a plurality of vertically disposed spray orifices. Wafer cassettes 60 are loaded onto the turntable and rotated around the spray post. A motor 62 controls the rotation of the turntable.

The plating solution supply line 34, water/nitrogen supply line 42, and nitrogen supply line 48 are connected to separate vertical channels, 64, 66 and 68, respectively, in the spray post 58, as shown in FIG. 3. A plurality of horizontally disposed orifices 70, 74 and 76 function as spray nozzles for the liquids or gases supplied to channels 64, 66 and 68, respectively. The orifice 70 is angularly disposed with the nitrogen orifice 70 at the apex so that the nitrogen stream will be injected behind the liquid stream atomizing the liquid stream into fine droplets.

The wafers to be processed are disposed in the cassettes 60 and held in a spaced stack so that plating solution ejected from the spray post can readily contact and traverse the horizontal surface of each individual wafer as it is rotated past the spray post orifices. In the process chamber of FIG. 2, the wafers are disposed horizontally. However, it is also possible to arrange the wafers vertically or at an angle between horizontal and vertical within the process chamber.

All valves in the apparatus of FIGS. 1–3 are electronically controlled so that they can be opened and closed in accordance with a predetermined sequence and the metering valves are equipped with mass or flow sensors so that precise control of the amount of fluid flowing therethrough can be achieved. The valves and sensors in the apparatus are preferably connected to a programmable controller 80 which includes a programmable computing unit so that the plating process of the invention can be automated simply by programming the contoller with an appropriate valve opening sequence, fluid flow, temperature, and sensor reading response program. The controller desirably also allows for regulation of the turntable speed and gas pressure.

While FIGS. 1–3 represent one possible apparatus set-up for practice of the invention, it should be understood that the invention can be practiced in other or modified devices. For instance more or fewer chemical solutions may be used and integrated into this system which means that more or fewer reservoirs, supply lines, and valves may be provided.

In another alternative embodiment the process chamber 40 may be modified to provide a wall mounted spray post directing its spray toward the center of the chamber. A single wafer cassette centrally mounted on the turntable so that the wafers spin about their own axis may be employed in this embodiment.

In another embodiment, manifold 10 may be dispensed with and separate connections to channels 64 and 66 of the spray post 58 may be provided. With this configuration the metal stock solution and reducing solution are mixed to provide the electroless plating solution at the time of dispensing on the substrate surface.

Process chamber structures which can be readily adapted to practice of the inventive method are disclosed in U.S. Pat. No. 3,990,462, U.S. Pat. No. 4,609,575, and U.S. Pat. No. 4,682,615, all incorporated herein by reference. An apparatus of the type shown in FIGS. 1–3, or the modifications just described, can be readily provided by modifying a commercial spray apparatus such as a FSI MERCURY® spray processing system, available from FSI Corporation, Chaska, Minn. Such a device includes suitable Teflon plumbing, including water supply, chemical feed lines, mixing manifold and gas sources; a process chamber housing suitable cassettes, turntable and spray post; and a programmable controller. Thus, providing such a processor with a metal stock solution reservoir and a reducing solution reservoir, optionally providing recycling lines 53, 55, valves 57, 59 and pumped tank 61, and providing a suitable program which causes the apparatus to feed the two solutions to the manifold so as to prepare the plating solution and then to spray the solution onto wafers in the process chamber using a nitrogen feed to atomize the feed, and intermittently rinsing and drying the system, is a sufficient modification of the commercial device to permit practice of the invention herein.

In a preferred apparatus for carrying out the invention, pressurized solution and pressurized nitrogen simultaneously flowing through the spray orifices 70 and 76, respectively, atomize the liquid solution creating small droplets of liquid with high kinetic energy. The droplets are transported to the surface of the rotating wafer where they form a liquid film on the wafer surface. As the wafer is rotated out and again into the spray path the liquid film is centrifugally stripped and resupplied. As a result of these processes, an exceptionally thin film develops. Deposition rate, uniformity, surface roughness and film purity dramatically improve because of this set-up and process.

In the present invention, a number of drawbacks of the immersion technique and equipment are avoided or minimized.

Controlled environment: The process chamber of the spray processor is sealed from the ambient. During nitrogen atomization, the chamber may be quickly filled with $N_2$.

Thinner effective diffusion layer: The electroless mist carries very high kinetic energy. The high energy spray impinges on the wafer surface, effectively reducing the diffusion layer. In addition, the spinning effect of the wafers during deposition also eject the spent plating solution, allowing new solution to get to the wafer surface. This results in both a more effective plating reaction and a higher deposition rate. The rotation rate may also be varied rapidly within a desired range of rotation rates, so as to further increase the turnover of solution on the substrate surface.

Other advantages of the present invention over conventional immersion processing include the following:

1. Electrical and thickness uniformity is improved.
2. Surface roughness of metal deposits decreases because the thickness of diffusion layer at solution-substrate interface is decreased.
3. Non-contaminated, pure metal films occur because the deposition, rinsing, and drying occur in one process chamber under controlled atmospheric conditions, without any wafer transfer from bath to bath or process module to process module.

4. Increased resistance to oxidation exists because the films are non-porous and the thin dense surface oxide layer formed on the metal surface protects the non-porous metal film from the oxidation.
5. Contiguous film morphology develops very quickly in very thin film layers, partly due to the continuous solution agitation, renovation, and thin diffusion layer.
6. Integration of several different deposited layers by means of changing the deposition solution being sprayed; also in situ priming and cleaning is possible.

By means of the invention, thin films only 100 Å thick which attain resistivity values approaching those of bulk metals can be prepared. Such thin films will match ULSI process architecture needs, especially in terms of topography, step coverage, and sidewall thickness control. Interconnect resistance and electromigration failures can be reduced, if not eliminated, through appropriate process controls. These highly conductive films address the major limitation (of RC time delays) holding back the achievement of high circuit speeds. As such, these films provide a fundamental improvement over current semiconductor layers deposited by conventional or state-of-the-art techniques. The thin films produced by the invention also have very small grains. Therefore this invention is useful for applications where thin films with small granularity are needed; such as magnetic or opto-magnetic memories (disks).

In addition to these benefits, the process can incorporate several deposition steps for different chemical compositions, thereby forming multi-layer thin films on a multitude of substrate surfaces. This process can be used to deposit thin films of Cu, Ni, Co, Fe, Ag, Au, Pd, Rh, Ru, Pt, Sn, Pb, Re, Te, In, Cd, and Bi. Other metals can be codeposited to form alloys. Examples include, but are not limited to, binary Cu alloys (CuNi, CuCd, CuCo, CuAu, CuPt, CuPd, CuBi, CuRh, CuSb, CuZn), binary Ni alloys (NiCo, NiRe, NiSn, NiFe, NiRh, NiIr, NiPt, NiRu, NiW, NiZn, NiCd, NiAg, NiTI, NiCr, NiV), and ternary alloys (NiFeSn, NiZnCd, NiMoSn, NiCoRe, NiCoMn, CoWP, CoWB).

The invention is illustrated by the following non-limiting examples.

EXAMPLES 1–11 AND COMPARATIVE EXAMPLE 1

The experiment was run in a spray processor which is similar to FIG. 1, except that the spray processor was set up for a single cassette rotating on a central axis and the spray post was located on the side of the process chamber. For the experiment, four-inch silicon wafers were used. A barrier/seed layer consisting of either three stratum of about 100 Å Ti, about 100 Å Cu and about 100 Å Al, or two stratum of about 100 Å Chromium and about 100 Å Gold, was sputtered on the wafers in order to provide a catalytic surface for copper electroless plating.

The electroless copper solution was divided into two components: a copper stock solution containing copper sulfate and ethylenediaminetetraacetic acid (EDTA); and a reducing solution containing formaldehyde and water. The copper stock solution was adjusted to pH of 12.4 to 12.7 at room temperature with potassium hydroxide and sulfuric acid. The solutions had the following compositions:

Copper Stock Solution:

| | |
|---|---|
| Copper sulfate pentahydrate | 8 grams |
| EDTA | 15 grams |
| 85% Potassium Hydroxide soln. | 30 grams |
| De-Ionized Water | 800 ml |

Reducing Solution:

| | |
|---|---|
| Formaldehyde (37% soln.) | 10 ml |
| De-Ionized Water | 200 ml |

The stock and reducing solutions were dispensed at a rate of 800 ml/minute and 200 ml/minute respectively. An IR heater raised the temperature of the resulting plating solution to approximately 70° C. The cooling action of Nitrogen atomization lowered the wafer temperature to approximately 60° C., an optimum temperature for electroless copper plating. Table 1 lists the operating parameters and results for Examples 1–11. For comparison, a typical result obtained by immersion plating is also included at the bottom of the table as Comparative Example 1.

In some cases as indicated in Table 1 below a polyethylene glycol surfactant, GAF RE-610, was added to the metal stock solution. The surfactant concentration given in Table 1 is the calculated concentration in the mixed plating solution.

TABLE 1

Experimental results achieved with the spray processor electroless plating

| Example | Barrier-Seed layer | Speed RPM | Nitrogen pressure PSI | Surfactant g/l | Flow cc/mm | Deposition Rate Å/min | Thickness Å | Resistivity microhm – cm | Roughness Å | Uniformity % |
|---|---|---|---|---|---|---|---|---|---|---|
| 1 | Ti/Cu/Al | 20 | 20 | 0.1 | 800 | 280 | 700 | 2.8 | 110 | 4 |
| 2 | Ti/Cu/Al | 20 | 40 | 0.1 | 800 | 320 | 800 | 3 | 75 | 5 |
| 3 | Ti/Cu/Al | 180 | 20 | 0.1 | 800 | 180 | 450 | 2.2 | 100 | 14 |
| 4 | Cr/Au | 20 | 30 | 0.05 | 800 | 480 | 1200 | 3.3 | 50 | 6 |
| 5 | Cr/Au | 20 | 40 | none | 800 | 560 | 1400 | 2.5 | 45 | 4 |
| 6 | Ti/Cu/Al | 20 | 28 | none | 800 | 420 | 1050 | 2.6 | 50 | 3 |
| 7 | Cr/Au | 20 | 20 | none | 800 | 700 | 1750 | 3 | 50 | 3 |
| 8 | Cr/Au | 20 | 30 | 0.05 | >1600 | 400 | 800 | 3 | 40 | 3 |
| 9 | Cr/Au | 20 | 20 | none | >1600 | 800 | 2000 | 2.7 | 100 | 4 |

TABLE 1-continued

Experimental results achieved with the spray processor electroless plating

| Example | Barrier-Seed layer | Speed RPM | Nitrogen pressure PSI | Surfactant g/l | Flow cc/mm | Deposition Rate Å/min | Thickness Å | Resistivity microhm – cm | Roughness Å | Uniformity % |
|---|---|---|---|---|---|---|---|---|---|---|
| 10 | Cr/Au | 20 | 20 | 0.05 | >1600 | 350 | 250 | 3 | 65 | 6 |
| 11 | Cr/Au | 20 | 20 | none | >1600 | 1800 | 4500 | 400 | 200 | 10 |
| Comparative Example 1 | | Immersion method, 58° C. bath | | | | 400 | 5000 | 3 | 1500 | 10 |

Consistently low resistivity values have been obtained for very thin copper films, with actual values approaching bulk resistivity values. The deposition rate with the spray processor is significantly higher than with the immersion method. A rate as high as 1800 Å/minute can be achieved, as compared to 500–600 Å/minute for the immersion method. Electrical and/or thickness uniformity is approximately 3 times better than with the immersion process (3% versus 10%). Surface roughness of the copper film decreases by an order of magnitude when the film is deposited by the spray method. For a 4500–5000 Å copper film, the spray method yields a roughness of 50–200 Å, as compared to approximately 1500 Å for the immersion method.

These results also compare very favorably to the properties of previously reported films. Resistivities and deposition rates in particular are much better suited to semiconductor fabrication than those values reported for films obtained by other deposition techniques.

After the deposition process, low temperature annealing was done at 250° C. for 3 hours. Afterwards, resistivity, roughness, electrical and thickness uniformity were measured. Very thin electroless Cu films (from 200 to 500 Å) had resistivity values of 2.2–2.6 microhm-cm, low surface roughness (in the range of 40–50 Å), and excellent electrical and thickness uniformity (about 3% deviation). Thin electroless Cu films (from 2000 to 5000 Å) had resistivity values of 1.8–1.9 microhm-cm (in comparison for resistivity values of 2.2–2.7 microhm-cm for as-deposited films), low surface roughness (in the range of 100–200 Å), and excellent electrical and thickness uniformity (about 3% deviation).

Figure 4:
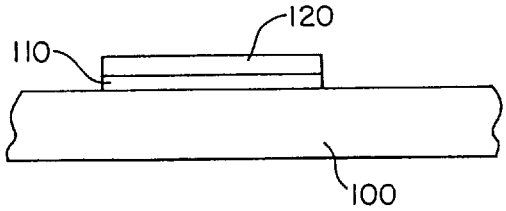
FIG. 4 is a fragmentary sectional view of a semiconductor device containing a deposited metal film prepared by the method of the invention.
Figure 5:
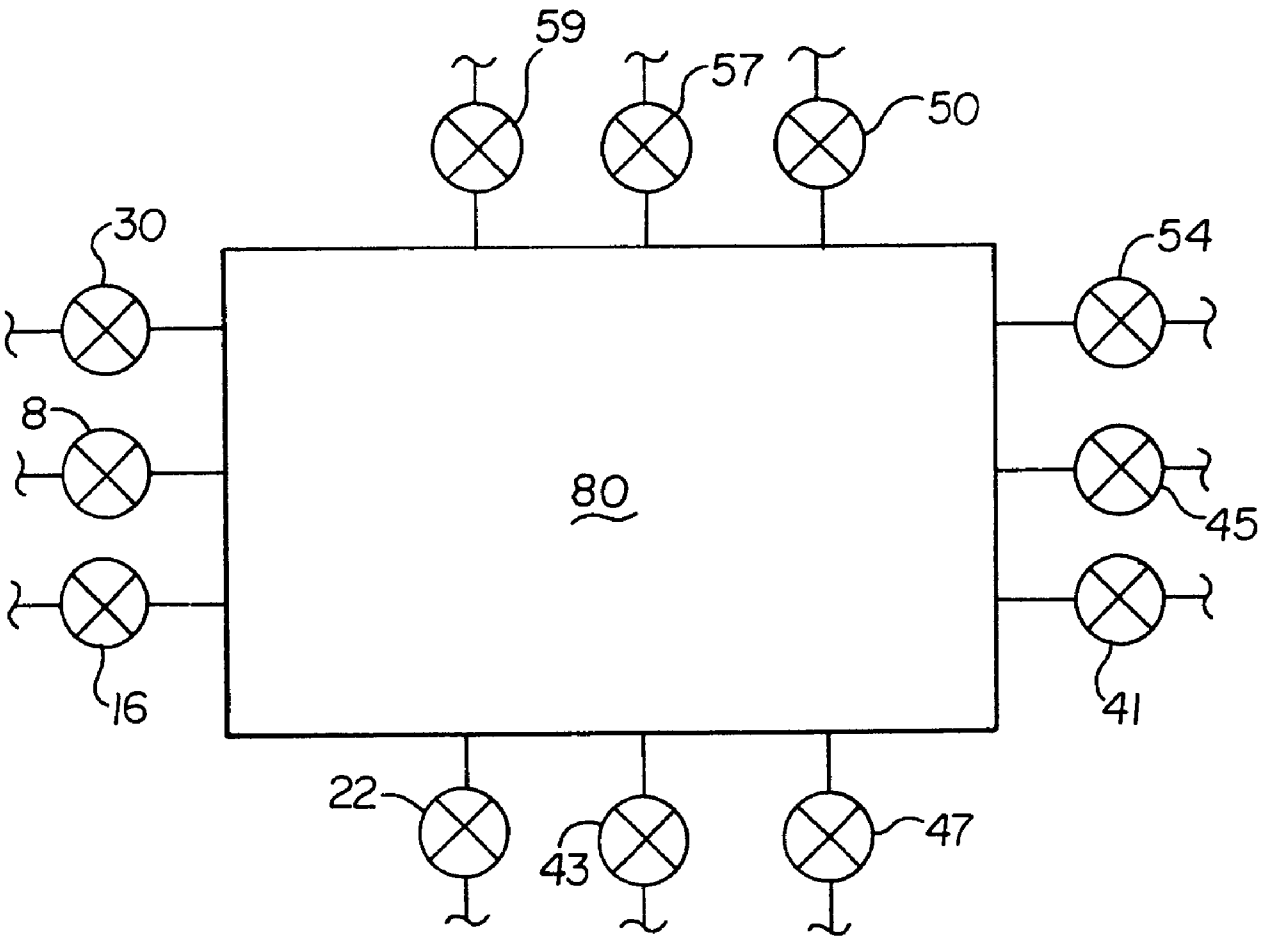
FIG. 5 is a schematic representation of a controller and valves controlled by it for use in carrying out the present invention

Referring to FIG. 4 there is shown a fragmentary view of a silicon wafer 100 onto which an adhesion/barrier-seed layer 110 of a thickness of between about 50 and 500 Å has been provided after which the wafer was subjected to a spray of an electroless plating solution in the manner set forth in the examples above. A deposited copper layer 120 results. Layer 120 has a thickness of between 250 and 4500 Å and a measured resistivity of between 2.2 and 3.8 microhm-cm.

EXAMPLES 12–18

The experiments were run in a spray processor as in the previous examples, except that the recirculating means was used and no nitrogen feed was employed. For the experiment, eight-inch silicon wafers were used. A barrier/seed layer consisting of three successive stratum of about 300 Å Ta, about 300 Å Cu and about 300 Å Al was sputtered on the wafers in order to provide a catalytic surface for copper electroless plating.

An electroless copper deposition solution was prepared with the following composition:

| | |
|---|---|
| Copper sulfate pentahydrate | 8 grams/liter |
| EDTA | 14 grams/liter |
| 85% Potassium Hydroxide soln. | 23 grams/liter |
| De-Ionized Water | 1 liter |
| GAF RE-610 | 0.01 grams/liter |
| Formaldehyde (37% soln.) | 5 ml/liter |

The solution was circulated through the spray processor apparatus via the recirculating pump at the rate of 10 liters/min. A resistive heating coil placed in the bath tank was used to raise the temperature of the plating solution to approximately 70° C. Table 2 lists the operating parameters and results.

TABLE 2

Experimental results achieved with the spray processor electroless plating

| Example | Speed RPM | Surfactant | Flow l/mm | Deposition Rate Å/min | Thickness Å | Resistivity microhm – cm |
|---|---|---|---|---|---|---|
| 12 | 10 | 0.01 | 10 | 929 | 18583 | 1.79 |
| 13 | 10 | 0.01 | 10 | 907 | 18141 | 1.81 |
| 14 | 10 | 0.01 | 10 | 755 | 15097 | 1.86 |
| 15 | 10 | 0.01 | 10 | 931 | 18634 | 1.79 |
| 16 | 60 | 0.01 | 10 | 490 | 9817 | 1.95 |
| 17 | 60 | 0.01 | 10 | 493 | 9867 | 1.98 |
| 18 | 60 | 0.01 | 10 | 341 | 6833 | 2.14 |

The formulations and test results described above are merely illustrative of the invention and those skilled in the art will recognize that many other variations may be employed within the teachings provided herein. Such variations are considered to be encompassed within the scope of the invention as set forth in the following claims.

What is claimed is:

1. An apparatus for deposition of a metal film onto a substrate, the apparatus comprising:

a) a first reservoir containing a metal stock solution comprising a solution of the metal to be deposited;

b) a second reservoir containing a reducing solution; the metal stock solution and reducing solution, when mixed in predetermined proportions forming an electroless plating solution, c) a mixing chamber for mixing said metal stock solution and said reducing solution to thereby provide said electroless plating solution;

d) first and second lines, respectively connecting the first and second reservoirs to the mixing chamber, said first and second lines including respective first and second controllable valves therein whereby predetermined quantities of the solutions in the respective reservoirs may be provided to the mixing chamber at selected times;

e) a process chamber for holding the substrate on which the metal film is to be deposited;

f) a supply line connecting the mixing chamber and the process chamber so as to allow for delivery of said electroless plating solution to said process chamber;

g) at least one spray post in the process chamber connected to the supply line for providing a spray of electroless plating solution on said substrate; and h) a controller in electrical communication with said first and second controllable valves, the controller including a computing unit having a control program installed therein, the controller operable to control said first and second controllable valves according to said control program so as to i) provide the metal stock solution and the reducing solution to the mixing chamber in said predetermined proportions to thereby form said electroless plating solution, and ii) provide said electroless plating solution to said spray head post so as to cause the substrate to be sprayed with said electroless plating solution.

2. The apparatus of claim 1 further comprising an inert gas supply and an inert gas supply line connecting said inert gas supply to the process chamber, the inert gas supply provided with a controllable inert gas supply valve in electrical communication with said controller whereby said inert gas may be provided to the process chamber at predetermined pressure or flow rate at selected times.

3. An apparatus as in claim 1 further including solution recirculating means for collecting electroless plating solution which has been sprayed in the process chamber and returning it to the spray post to be resprayed.

4. An apparatus as in claim 1 further comprising a rotatable carrier for the substrate operable to spin the substrate while the plating solution is being sprayed.

5. An apparatus as in claim 4 wherein the rotatable carrier and spray post are configured to intermittently pass the substrate in and out of the path of the spray emitted from the spray post as the carrier is rotated.

6. An apparatus as in claim 1 wherein the rotatable carrier and spray post are configured to maintain the substrate in the path of the spray emitted from the spray post as the carrier is rotated.

7. An apparatus as in claim 2 wherein the spray post is also connected to the inert gas source, the spray post providing an atomized spray of electroless plating solution in a carrier of said inert gas on said substrate when said electroless plating solution and inert gas are simultaneously provided thereto, and said controller is configured to operate the controllable inert gas supply valve and first controllable valve so as to provide said electroless plating solution and said inert gas to the spray post simultaneously so as to cause the substrate to be sprayed with an atomized spray of said electroless plating solution in inert gas carrier.

8. An apparatus as in claim 1 wherein said spray post is configured to provide a substantially continuous stream of said electroless plating solution to the substrate.

9. An apparatus as in claim 1 wherein said apparatus is comprised of more than one spray post.

* * * * *